US011756522B2

(12) United States Patent
Yi et al.

(10) Patent No.: US 11,756,522 B2
(45) Date of Patent: Sep. 12, 2023

(54) NOISE MASKING METHOD THROUGH VARIABLE MASKING SOUND LEVEL CONVERSION

(71) Applicant: Aquris Co., Ltd, Anyang (KR)

(72) Inventors: Jung-hwan Yi, Gimpo (KR); Chan-goo Kang, Suwon (KR); Jong-Bo Kim, Seongnam (KR)

(73) Assignee: Aquris Co., Ltd, Anyang (KR)

( * ) Notice: Subject to any disclaimer, the term of this patent is extended or adjusted under 35 U.S.C. 154(b) by 0 days.

(21) Appl. No.: 17/746,659

(22) Filed: May 17, 2022

(65) Prior Publication Data

US 2022/0375447 A1 Nov. 24, 2022

(30) Foreign Application Priority Data

May 20, 2021 (KR) ..... 10-2021-64883

(51) Int. Cl.
*G10K 11/175* (2006.01)
*G10K 11/178* (2006.01)

(52) U.S. Cl.
CPC .... *G10K 11/1752* (2020.05); *G10K 11/17821* (2018.01); *G10K 2210/3023* (2013.01)

(58) Field of Classification Search
CPC ..... G10K 11/1752; G10K 11/17821; G10K 2210/3023
USPC ..... 381/73.1
See application file for complete search history.

(56) References Cited

U.S. PATENT DOCUMENTS

2006/0188104 A1* 8/2006 De Poortere ..... H03G 5/165 381/102
2008/0181422 A1* 7/2008 Christoph ..... G10K 11/17817 381/73.1
2008/0285775 A1* 11/2008 Christoph ..... H04S 7/301 381/103
2013/0163777 A1* 6/2013 Tashiro ..... H04K 3/41 381/73.1
2015/0043744 A1* 2/2015 Lagodzinski ..... H04R 3/002 381/73.1

FOREIGN PATENT DOCUMENTS

KR 10-1816691 B1 2/2018

* cited by examiner

*Primary Examiner* — Vivian C Chin
*Assistant Examiner* — Douglas J Suthers
(74) *Attorney, Agent, or Firm* — Heedong Chae; Lucem, PC

(57) ABSTRACT

One aspect of the present disclosure relates to a noise masking method through variable masking sound level conversion, capable of adjusting an interval for changing a level of a masking sound for masking noise to an optimal interval so that the masking sound is not perceived as noise, by determining a fluctuation trend of a level of audible noise and adjusting the interval for changing the level of the masking sound for masking the noise into an optimal environment through a control unit.

5 Claims, 9 Drawing Sheets

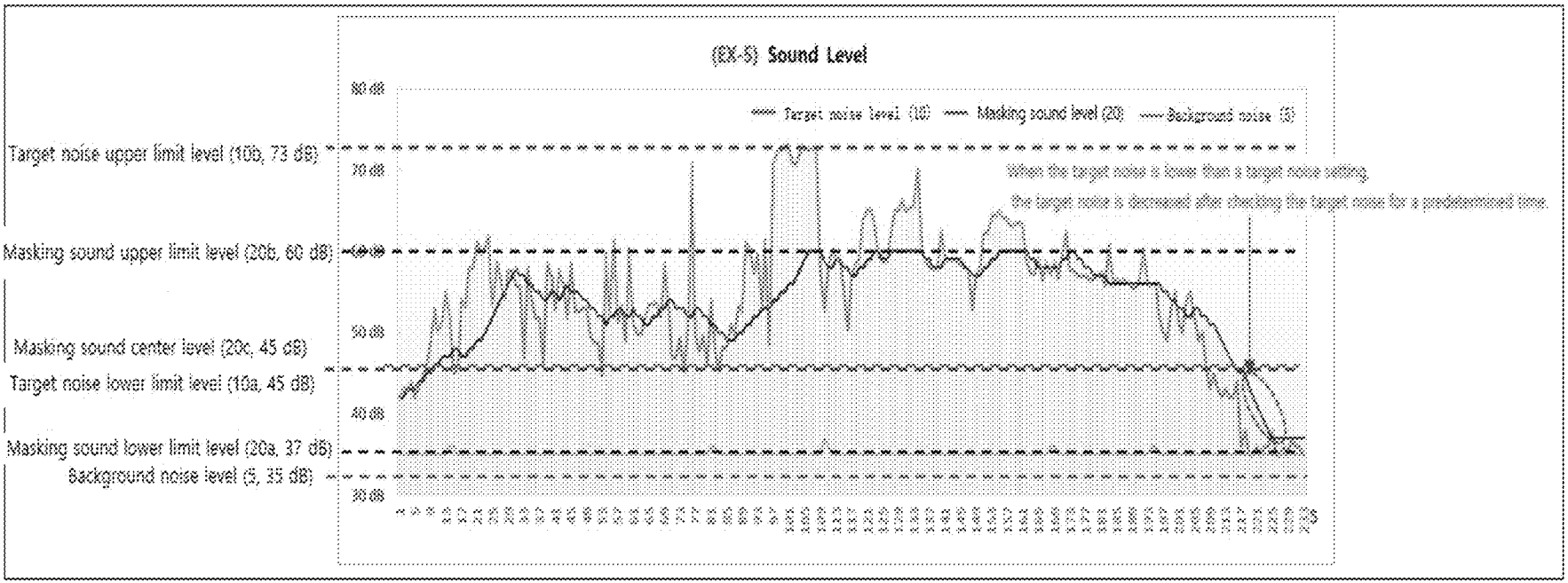
(EX-5) Sound Level
Target noise level (10) ---- Masking sound level (20) ---- Background noise (5)
When the target noise is lower than a target noise setting
The target noise is decreased after masking the target noise by a predetermined time.
Target noise upper limit level (10b, 73 dB)
Masking sound upper limit level (20b, 60 dB)
Masking sound center level (20c, 45 dB)
Target noise lower limit level (10a, 45 dB)
Masking sound lower limit level (20a, 37 dB)
Background noise level (5, 35 dB)
80 dB
70 dB
60 dB
50 dB
40 dB
30 dB
0
5
10
15
20
25
30
35
40
45
50
55
60
65
70
75
80
85
90
95
100
105
110
115
120
125
130
135
140
145
150
155
160
165
170
175
180
185
190
195

NOISE MASKING METHOD THROUGH VARIABLE MASKING SOUND LEVEL CONVERSION

CROSS-REFERENCE TO RELATED APPLICATIONS

This application claims the priority of Korean Patent Application No. 10-2021-64883 filed on May 20, 2021, in the Korean Intellectual Property Office, the disclosure of which is incorporated herein by reference.

BACKGROUND OF THE INVENTION

1. Field of the Invention

One aspect of the present disclosure relates to a noise masking method, and more particularly, to a noise masking method through variable masking sound level conversion, capable of optimizing a masking sound so that the masking sound is not perceived as noise, by determining a fluctuation trend of a level of audible noise and adjusting an interval for changing a level of the masking sound for masking the noise according to the determined fluctuation trend through a control unit.

2. Description of the Related Art

Sound masking is a technology that makes ambient noise less recognizable by generating an artificial sound such as white noise. For example, the sound masking may make noise of other people or machinery less disturbing in a noisy place such as a call center, an office, a waiting room, or auditorium, or may serve to protect personal information or confidential information in a place where security is required, such as a medical facility, a bank, a government institution, or a research facility. In addition, in a place such as a library, even a small noise may interrupt concentration due to an excessively quiet environment, so that an artificial sound may be generated to make sounds of other people less recognizable. Meanwhile, noise in each place may not be always maintained at a constant level, but may be changed irregularly from moment to moment. Further, a level of noise may vary for each zone even within one indoor space, and there is a limitation in that a conventional monotony sound masking technology may not effectively cope with such various noise environments.

In order to solve the above problems, Korean Patent Registration No. 10-1816691 (published on Feb. 21, 2018) has disclosed a "Sound Masking System", which relates to a sound masking system including: a noise sensing unit installed for each acoustic zone within a space partitioned into at least one acoustic zone, and configured to sense noise generated in each acoustic zone; a processor for determining, for each acoustic zone, a waveform, a sound pressure level, or a provision state of an artificial sound signal for masking the noise; sound masking units, each including a sound output unit for outputting the artificial sound signal determined for each acoustic zone by the processor to the acoustic zone corresponding to the artificial sound signal; and a control terminal for transmitting a control signal for controlling at least some of the sound masking units to the processor included in each of the sound masking units through wireless communication.

The conventional sound masking system has an advantage of outputting an artificial sound corresponding to noise generated in each acoustic zone, and a technology for adjusting a sound pressure level according to a change of the noise has been exhibited. However, a specific method for the technology for adjusting the sound pressure level according to the change of the noise has not been proposed, and the conventional sound masking system is configured to immediately change a level of a masking sound according to the change of the noise, so that the masking sound itself may be perceived as noise, which may disturb concentration of people.

In addition, since both generated noise and a masking sound, which is an artificial sound, are audible sounds synthesized within an audible frequency band in terms of acoustics, it may be difficult to distinguish the generated noise from the masking sound, so that when the masking sound output from the masking system is larger than noise that is actually generated, the masking sound may be recognized as noise so as to cause an error of continuously increasing a level of the masking sound, which makes it very important to distinguish the generated noise from the masking sound. However, a specific method for a technology related thereto has not been proposed.

DOCUMENTS OF RELATED ART

Patent Documents (Patent Document 0001) Korean Patent Registration No. 10-1816691 (published on Feb. 21, 2018), "Sound Masking System"

[National Research and Development Projects Supporting this Invention]

| | |
|---|---|
| [Task unique number] | |
| [Task number] | 20008795 |
| [The name of the ministry] | Ministry of Commerce, Industry and Energy |
| [Task management (specialized) organization name] | Korea Evaluation Institute of Industrial Technology |
| [Research project name] | Development of Core Technology in Knowledge Service Industry-Manufacturing Service Convergence Technology Development Project |
| [Research subject name] | Development of a smart device equipped with noise cancelling technology and an artificial intelligence virtual assistant service for application of speech recognition specialized in manufacturing sites |
| [Contribution rate] | 1/1 |
| [Name of the organization performing the task] | MISOINFO Tech., Aquris Co., Ltd., Powervoice Co., Ltdl, BIMatrix Co., Ltd |
| [Research Period] | 2020 May 1~2022 Dec. 31 |

SUMMARY OF THE INVENTION

To solve the problems described above, an object of one aspect of the present disclosure is to provide a noise masking method through variable masking sound level conversion, capable of minimizing a deviation of fluctuating noise by optimizing a masking sound so that the masking sound is not perceived as noise, by determining a fluctuation trend of a level of audible noise and adjusting fluctuation of a level of the masking sound for masking the noise and an interval of the fluctuating level according to the determined fluctuation trend through a control unit.

To achieve the objects described above, according to one aspect of the present disclosure, there is provided a noise masking method through variable masking sound level conversion, which is a method of masking target noise by transmitting a target noise level collected through a sensor to a control unit, generating a masking sound for masking the target noise through the control unit, and outputting the masking sound through an output device, the noise masking method including: a target noise upper and lower limit level recognition step (S10) of recognizing a lower limit level and an upper limit level of the target noise; a masking sound center level setting step (S20) of setting a center level of the masking sound based on the lower limit level and the upper limit level of the target noise recognized in the target noise upper and lower limit level recognition step (S10); a masking sound upper and lower limit level setting step (S30) of setting a lower limit level and an upper limit level of the masking sound based on the center level of the masking sound set in the masking sound center level setting step (S20); a target noise level detection step (S40) of detecting the target noise level by comparing the target noise with noise output as the masking sound in ambient noise collected from the sensor; a masking sound level adjustment step (S50) of adjusting a level of the masking sound to a level set in the masking sound upper and lower limit level setting step (S30) by determining a fluctuation trend of the target noise level through the control unit according to a level of ambient noise collected in real time through the sensor; a masking sound interval adjustment step (S60) of adjusting a level change interval of the masking sound by determining the fluctuation trend of the target noise level in performing the masking sound level adjustment step (S50); and a masking sound output step (S70) of outputting the masking sound through the output device based on the level of the masking sound adjusted through the control unit in the masking sound level adjustment step (S50).

In addition, the noise masking method may further include a background noise level recognition step (S5) of recognizing a level of background noise before performing the target noise upper and lower limit level recognition step (S10).

In addition, in the masking sound level adjustment step (S50), the fluctuation trend of the target noise level may be determined based on an average value of the target noise level (10) from a predetermined time before a current time point to the current time point.

In addition, in the masking sound interval adjustment step (S60), the level change interval of the masking sound may be adjusted when an increase or a decrease of the target noise continues to rapidly fluctuate for a predetermined time, the interval may refer to an interval at which the masking sound level is changed, and a device for adjusting the interval may be provided.

In addition, in the masking sound level adjustment step (S50), when a change state is determined to be maintained for a predetermined time after the target noise is increased or decreased by a predetermined level or more, a level value of the masking sound may be changed to the upper or lower limit level set in the masking sound upper and lower limit level setting step (S30) through the control unit.

In addition, in the masking sound level adjustment step (S50), when the target noise level is determined to be maintained lower than the lower limit level of the target noise for a predetermined time, the level of the masking sound may be decreased to the lower limit level of the masking sound through the control unit.

According to the noise masking method through the variable masking sound level conversion of one aspect of the present disclosure, through the control unit, the fluctuation trend of the level of the audible noise is determined, the level of the masking sound for masking the noise is changed according to the determined fluctuation trend, and the interval of the changed level is adjusted, so that the masking sound can be prevented from being perceived as noise by a user.

BRIEF DESCRIPTION OF THE DRAWINGS

FIG. 9 is a view showing an example of a noise masking method through variable masking sound level conversion according to yet another embodiment of the present disclosure.

DETAILED DESCRIPTION OF THE INVENTION

Figure 1:
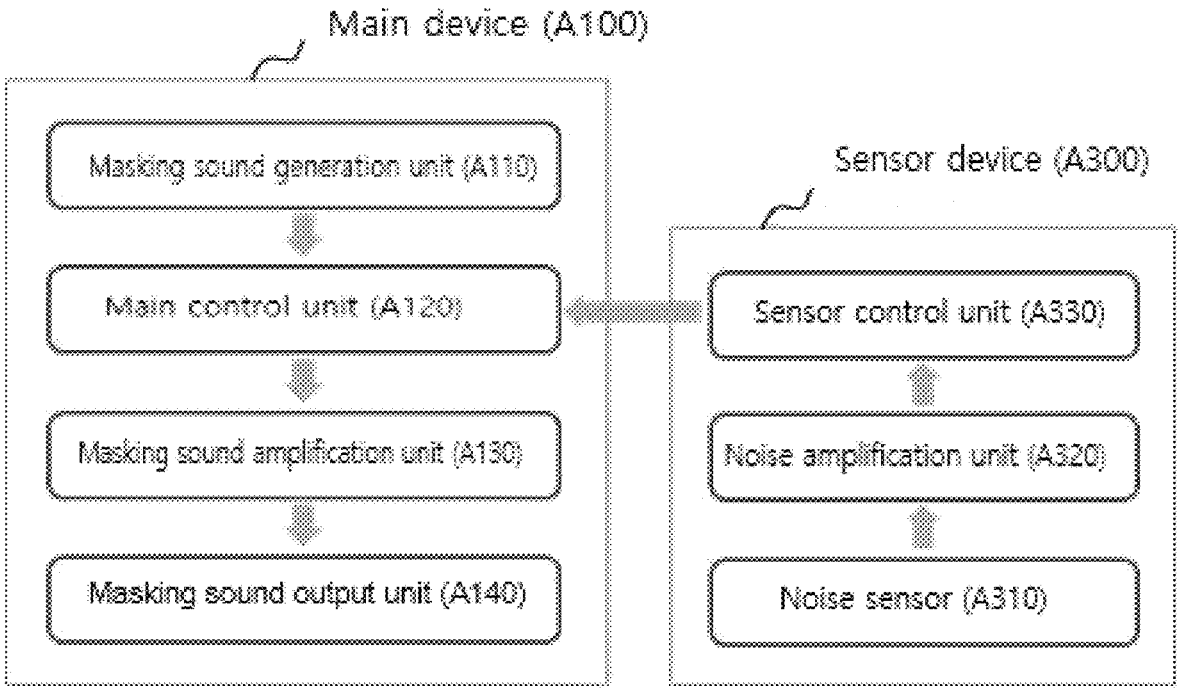
FIG. 1 is a flowchart showing a process of operating a variable sound masking system according to an embodiment of the present disclosure.

The following detailed descriptions of the present disclosure are given for embodiments in which the present disclosure may be practiced, and refer to the accompanying drawings that illustrate the embodiments. These embodiments are described in sufficient detail to enable those skilled in the art to practice the present disclosure. It is to be understood that various embodiments of the present disclosure are different from each other, but need not be mutually exclusive. For example, specific shapes, structures, and characteristics described herein may be implemented and changed from one embodiment to another embodiment without departing from the idea and scope of the present disclosure. In addition, it is to be understood that positions or arrangements of individual elements in each embodiment described herein may vary without departing from the idea and scope of the present disclosure.

Therefore, the following detailed description is not to be taken in a limiting sense, and the scope of the present disclosure is defined only by the appended claims while encompassing the scope of all equivalents of the claimed disclosure when appropriately described. In the drawings, like reference numerals refer to elements that perform the same or similar functions in various aspects.

Regarding the terms used herein, general terms that are currently used as widely as possible are selected in consideration of functions thereof in the present disclosure. However, the meanings of the terms may vary according to the intention of those skilled in the art, judicial precedents, the emergence of new technologies, and the like. In addition, in certain cases, a term may be selected at discretion of the applicant. In this case, the meaning of the term will be described in detail at a corresponding part in the description of the invention. Therefore, the terms used herein are to be defined based on the meanings of the terms and the contents throughout the present disclosure without being simply limited to names of the terms.

In the present disclosure, when some part "includes" some elements, unless explicitly described to the contrary, it means that other elements may be further included but not excluded.

FIG. 1 is a flowchart showing a process of operating a variable sound masking system according to an embodiment of the present disclosure.

Figure 2:
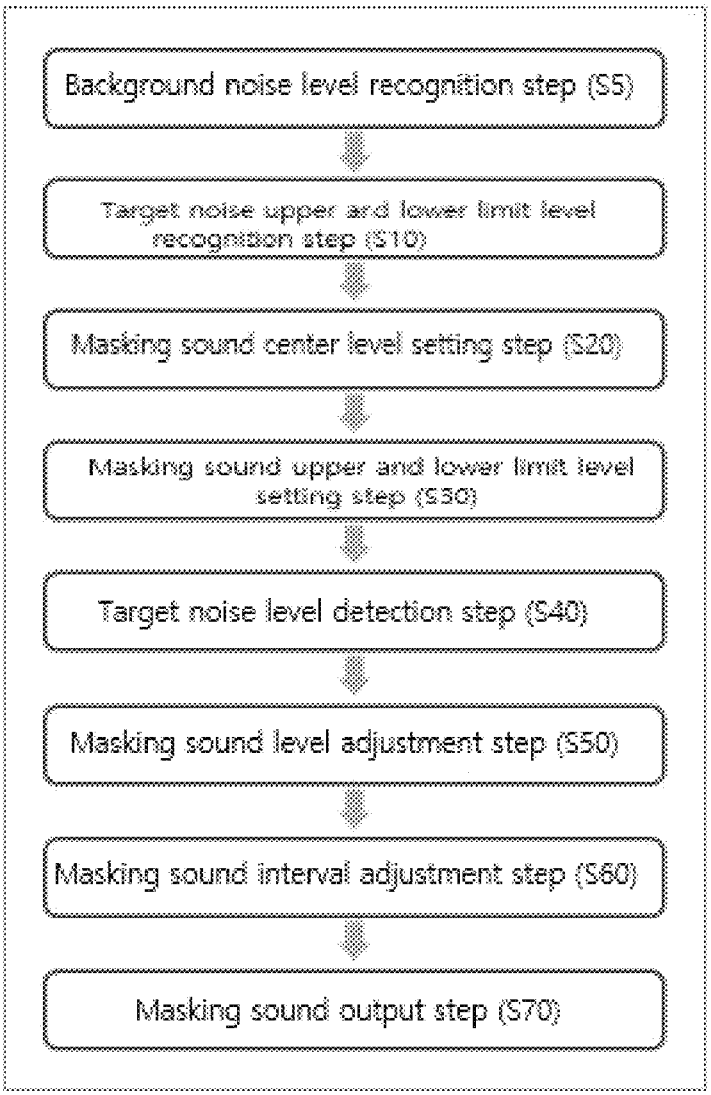
FIG. 2 is a flowchart showing processes of a noise masking method through variable masking sound level conversion according to an embodiment of the present disclosure.
Figure 3:
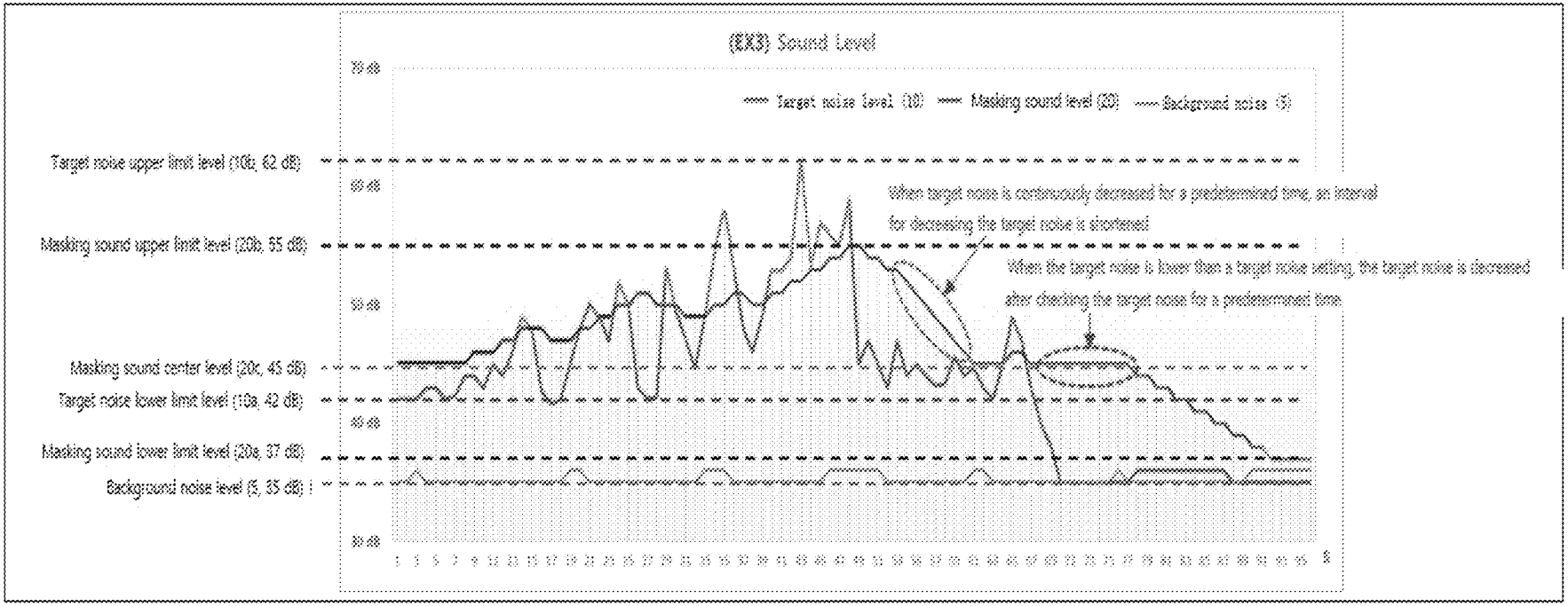
FIG. 3 is a view showing an example of the noise masking method through the variable masking sound level conversion according to the embodiment of the present disclosure.
Figure 4:
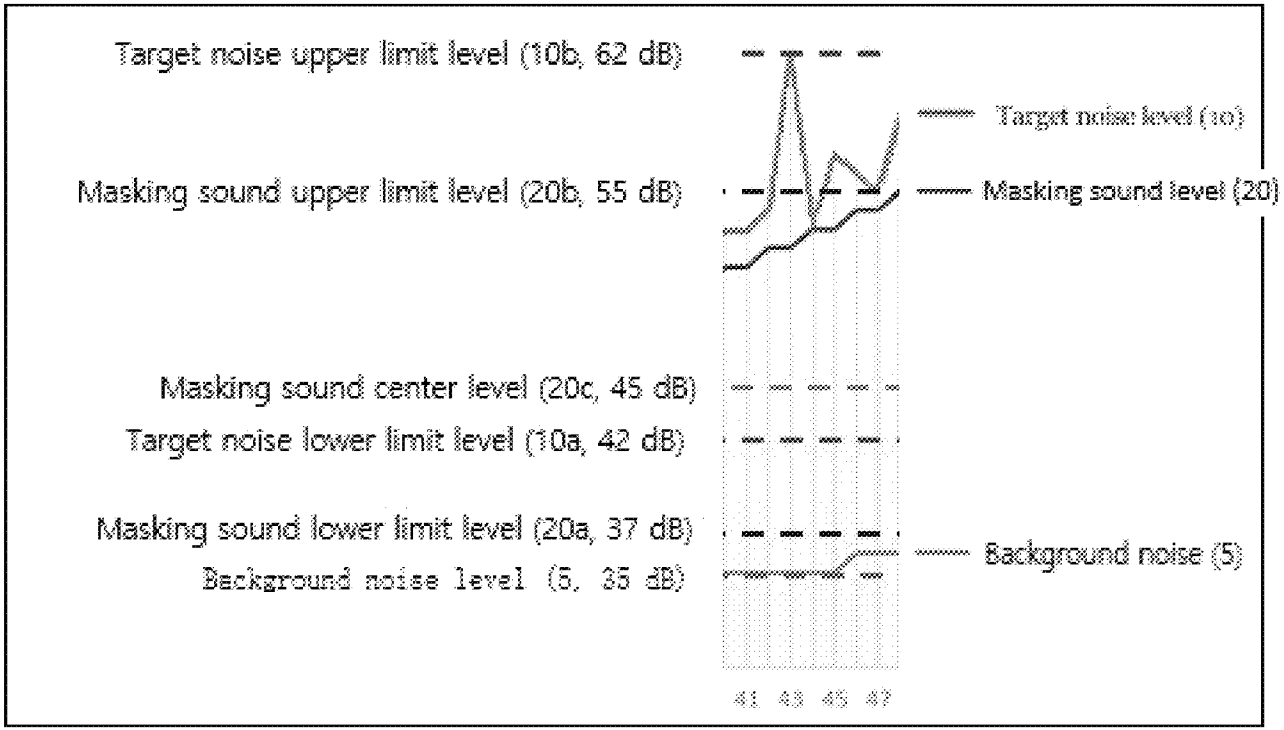
FIG. 4 is a view showing an example of a level change of a masking sound when a target noise level does not significantly fluctuate in the noise masking method through the variable masking sound level conversion according to the embodiment of the present disclosure.
Figure 5:
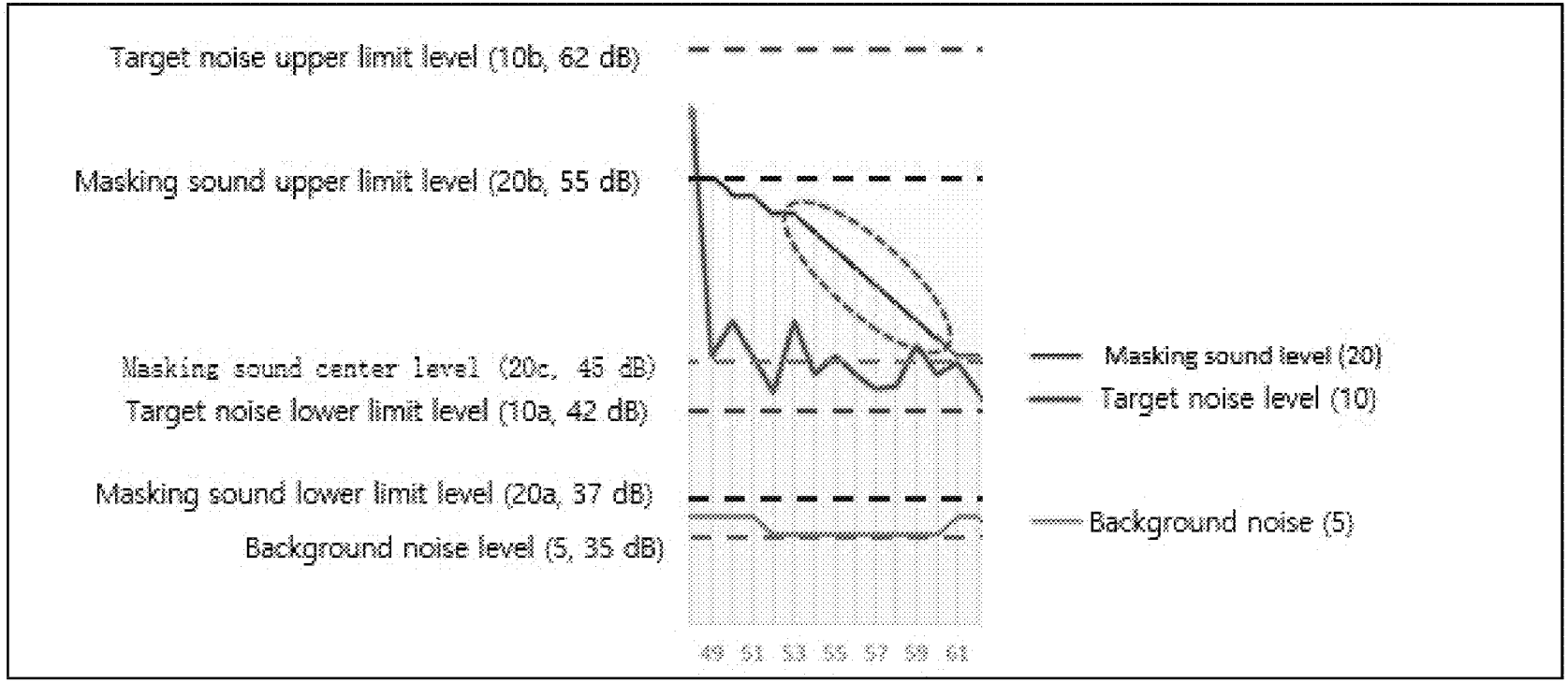
FIG. 5 is a view showing an example of processes of determining that a change state is maintained for a predetermined time after target noise is increased or decreased by a predetermined level or more and changing an interval for changing a level value of the masking sound in the noise masking method through the variable masking sound level conversion according to the embodiment of the present disclosure.
Figure 6:
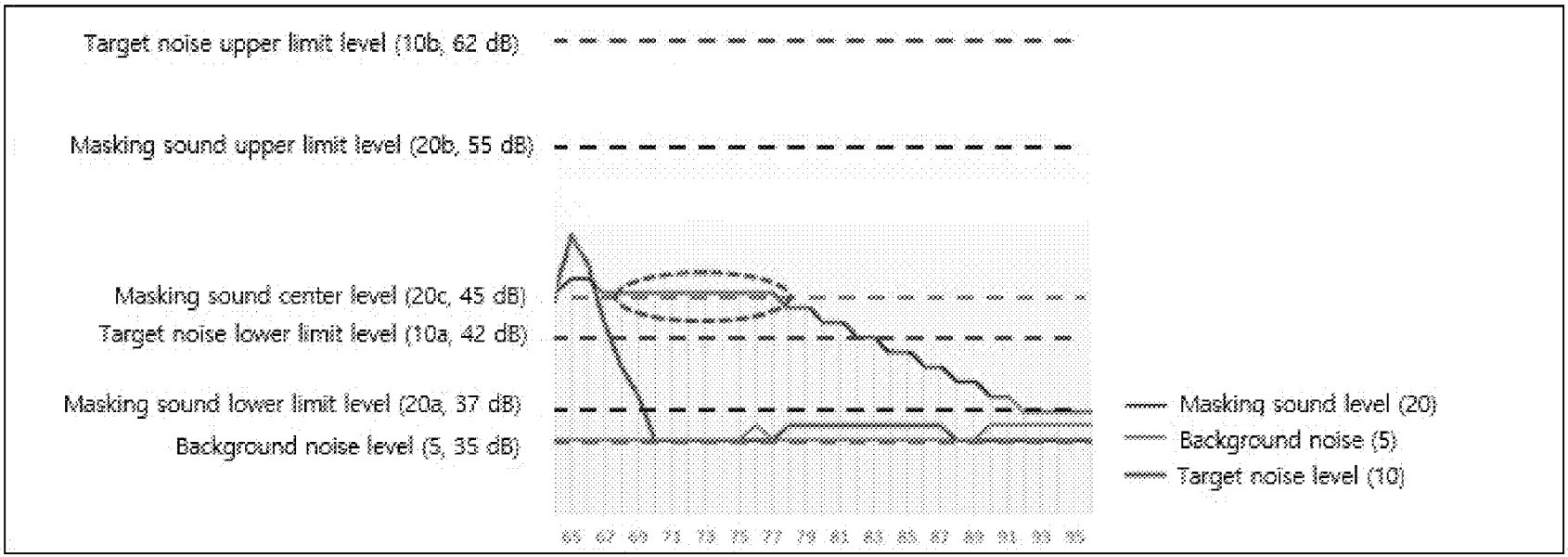
FIG. 6 is a view showing an example of processes of determining that the target noise level is maintained lower than a lower limit level of the target noise for a predetermined time and decreasing the level value of the masking sound to a lower limit level of the masking sound in the noise masking method through the variable masking sound level conversion according to the embodiment of the present disclosure.
Figure 7:
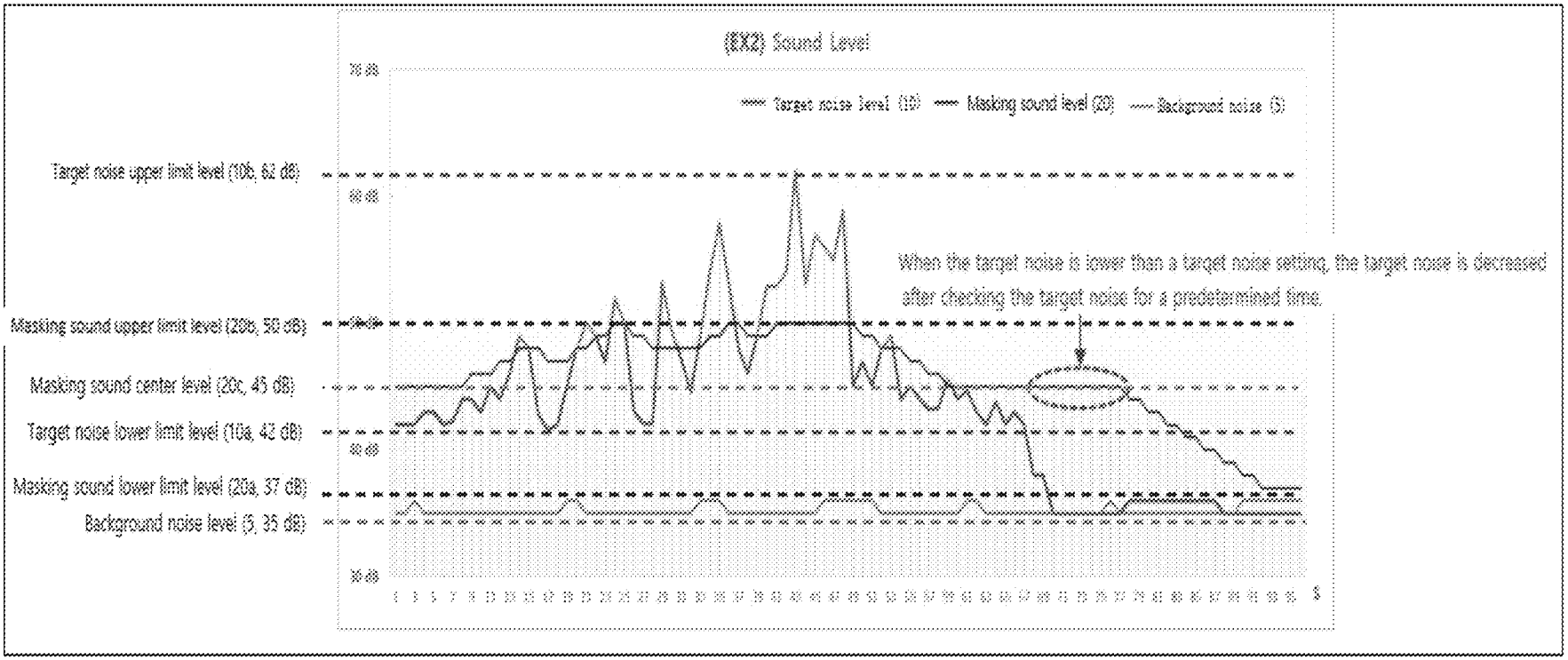
FIG. 7 is a view showing an example of a noise masking method through variable masking sound level conversion according to another embodiment of the present disclosure.
Figure 8:
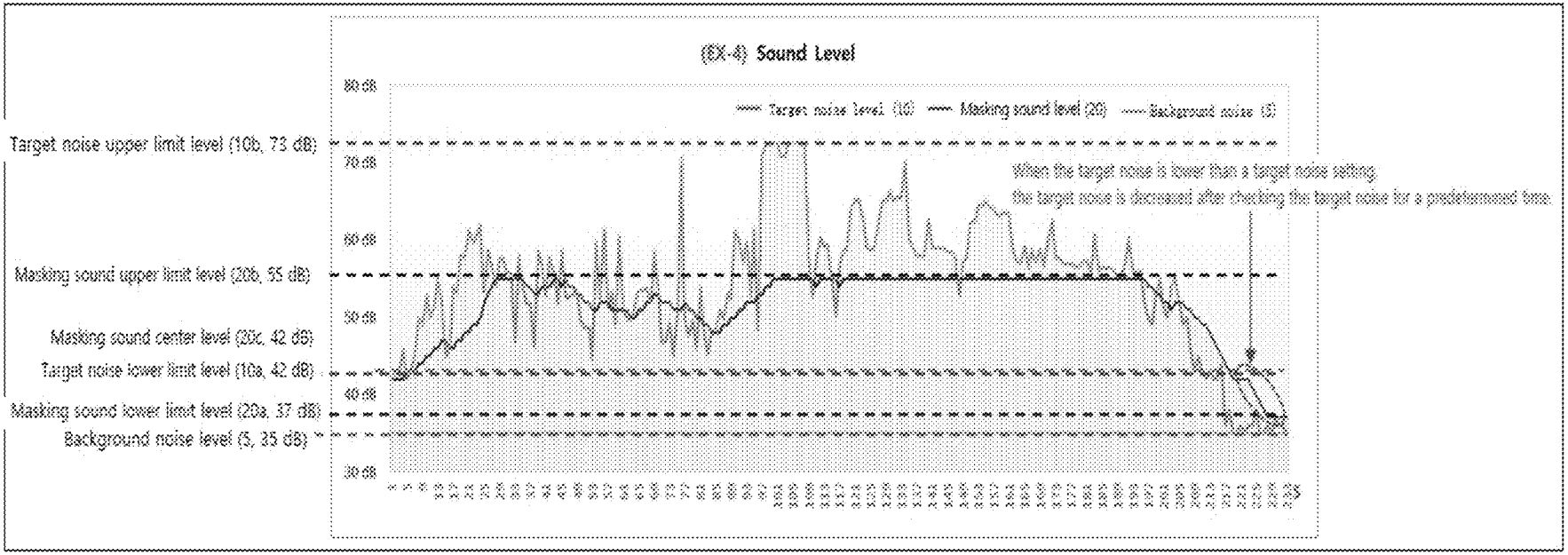
FIG. 8 is a view showing an example of a noise masking method through variable masking sound level conversion according to still another embodiment of the present disclosure.

FIG. 2 is a flowchart showing processes of a noise masking method through variable masking sound level conversion according to an embodiment of the present disclosure, FIG. 3 is a view showing an example of the noise masking method through the variable masking sound level conversion according to the embodiment of the present disclosure, FIG. 4 is a view showing an example of a level change of a masking sound when a target noise level does not significantly fluctuate in the noise masking method through the variable masking sound level conversion according to the embodiment of the present disclosure, FIG. 5 is a view showing an example of processes of determining that a change state is maintained for a predetermined time after target noise is increased or decreased by a predetermined level or more and changing an interval for changing a level value of the masking sound in the noise masking method through the variable masking sound level conversion according to the embodiment of the present disclosure, FIG. 6 is a view showing an example of processes of determining that the target noise level is maintained lower than a lower limit level of the target noise for a predetermined time and decreasing the level value of the masking sound to a lower limit level of the masking sound in the noise masking method through the variable masking sound level conversion according to the embodiment of the present disclosure, and FIGS. 7 to 9 are views showing examples of a noise masking method through variable masking sound level conversion according to another embodiments of the present disclosure.

One aspect of the present disclosure provides a noise masking method through variable masking sound level conversion, which is a method of masking target noise by transmitting a target noise level 10 collected through a noise sensor A310 of a sensor device A300 to a main control unit A120 of a main device A100 through a noise amplification unit A320 and a sensor control unit A330, generating a masking sound for masking the target noise through a masking sound generation unit A110, amplifying the masking sound to a masking sound level that is actually output through a masking sound amplification unit A130, and outputting the masking sound through a masking sound output unit A140 as shown in FIG. 1, the noise masking method including:

a target noise upper and lower limit level recognition step S10 of recognizing a lower limit level 10*a* of the target noise and an upper limit level 10*b* of the target noise; a masking sound center level setting step S20 of setting a center level 20*c* of the masking sound based on the lower limit level 10*a* of the target noise and the upper limit level 10*b* of the target noise recognized in the target noise upper and lower limit level recognition step S10; a masking sound upper and lower limit level setting step S30 of setting a lower limit level 20*a* of the masking sound and an upper limit level 20*b* of the masking sound based on the center level of the masking sound 20*c* set in the masking sound center level setting step S20; a target noise level detection step S40 of detecting, through the main control unit A120, the target noise level 10 obtained by excluding the masking sound level 20 from an ambient noise level 10 collected in real time through the noise sensor A310;

a masking sound level adjustment step S50 of changing the masking sound level 20 by determining a fluctuation trend of the target noise level 10 through the main control unit A120 according to the ambient noise level 10 collected in real time through the noise sensor A310; a masking sound interval adjustment step S60 of adjusting an interval for changing the masking sound level 20 by determining the fluctuation trend of the target noise level 10 through the main control unit A120 according to the ambient noise level 10 collected in real time through the noise sensor A310; and a masking sound output step S70 of outputting the masking sound through the masking sound output unit A140 based on the masking sound level 20 adjusted through the main control unit A120 in the masking sound level adjustment step S50, as shown in FIG. 2.

First, before a full description, terms used herein will be briefly defined.

The term "target noise" refers to noise that is generated in surroundings in daily life, which is to be cancelled or neutralized in the present disclosure. In this case, the term "target noise level 10" means a magnitude of target noise.

Meanwhile, there is "background noise" in addition to the target noise, and the term "background noise" refers to slight ambient noise except for the "target noise". For example, in a case of an office, the term "background noise" refers to slight noise that is spread while all operating devices are stopped. In this case, the term "background noise level 5" refers to a magnitude of the background noise.

Meanwhile, the term "masking sound" refers to a sound that is artificially generated through a "masking sound generation unit A110" and a "masking sound output unit A140" in order to cancel or neutralize the "target noise". In this case, the term "masking sound level 20" refers to a magnitude of the masking sound.

The "masking sound" corresponds to a predetermined type of sound that is continuously transmitted, in which a sound similar to a sound of wind or an air conditioner is transmitted to cancel or neutralize noise. According to the present disclosure, the "masking sound level 20" for the transmission may be changed according to the "target noise level 10", and when the "masking sound level 20" is changed too rapidly, the "masking sound" itself may be recognized as the noise, so that concentration of people located in a space may be interrupted. Accordingly, the "masking sound level 20" needs to be appropriately adjusted so as not to be changed too rapidly.

The term "level" represents a magnitude value of a sound, which represents a magnitude of the "target noise", the "background noise", or the "masking sound", and is expressed in dB (decibel).

Meanwhile, the term "trend" refers to a fluctuation trend of the target noise level 10 determined through the "main control unit A120", which is determined based on an average value of the target noise level 10 from a predetermined time before a current time point to the current time point. Alternatively, the term "trend" may be determined based on a rapid fluctuation of the target noise level 10 by a predetermined level or more within a predetermined period.

In more detail, the "trend" may be basically determined based on an average value of the target noise level 10 from 0 to 10 seconds before a current time point to the current time point, in which a criterion of the target noise level 10 that is regarded as an increase or a decrease of the target noise level 10 within 0 to 10 seconds may be set by a manager, and the "trend" may be determined based on the set criterion. Meanwhile, the "trend" may be recognized by determining that the target noise level 10 is lower than a preset lower limit level 10*a* of the target noise.

The "trend" may be determined through the "main control unit A120", and the above configuration is merely one example, so various implementations may be applied. The "main control unit A120" may classify the "trend" into categories such as a "gradual increase", a "gradual decrease", a "rapid increase", a "rapid decrease", and "below the target noise lower limit level 10*a*".

For example, in a case of the "gradual increase" in the "trend", when an average value of the target noise level 10 is increased by 10 dB or less within 0 to 10 seconds, the "main control unit A120" may determine this state as a "gradual increase" state.

For example, in a case of the "gradual decrease" in the "trend", when the average value of the target noise level 10 is decreased by 10 dB or less within 0 to 10 seconds, the "main control unit A120" may determine this state as a "gradual decrease" state.

For example, in a case of the "rapid increase" in the "trend", when the average value of the target noise level 10 is increased by 10 dB or more within 0 to 10 seconds, the "main control unit A120" may determine this state as a "rapid increase" state.

For example, in a case of the "rapid decrease" in the "trend", when the average value of the target noise level 10 is decreased by 10 dB or more within 0 to 10 seconds, the "main control unit A120" may determine this state as a "rapid decrease" state.

For example, in a case of "below the target noise lower limit level 10*a*" in the "trend", when the average value of the target noise level 10 is measured to be lower than a preset lower limit level 10*a* of the target noise, the "main control unit A120" may determine this state as a "below the target noise lower limit level 10*a*" state.

The above examples are only one example, and various categories and numerical values may be applied in addition to the above-described configurations.

Meanwhile, the term "interval" refers to a time interval during which the masking sound level 20 is changed.

For example, it may be found in FIG. 4 that the masking sound level 20 is increased in stages between 40 seconds and 48 seconds. In other words, it may be found that the masking sound level 20 is maintained between 40 seconds and 41 seconds, the masking sound level 20 is increased by 1 dB between 41 and 42 seconds, the masking sound level 20 is maintained between 42 seconds and 43 seconds, and the masking sound level 20 is increased by 1 dB between 43 seconds and 44 seconds, which are repeatedly exhibited. In this case, a time point at which the masking sound level 20 is changed appears once every 2 seconds, so that the time interval during which the masking sound level 20 is changed, that is, the "interval" may be regarded as "2 seconds".

Meanwhile, it may be found in FIG. 4 that the masking sound level 20 is decreased every second between 53 seconds and 61 seconds. In other words, it may be found that the masking sound level 20 is decreased by 1 dB every second, such as between 53 seconds and 54 seconds, between 54 seconds and 55 seconds, and between 55 seconds and 56 seconds. In this case, the interval during which the masking sound level 20 is changed, that is, the "interval" may be regarded as "1 second".

First, in implementing a noise masking method through variable masking sound level conversion according to one aspect of the present disclosure, a target noise upper and lower limit level recognition step S10 may be performed.

In the target noise upper and lower limit level recognition step S10, the lower limit level 10*a* of the target noise and the upper limit level 10*b* of the target noise may be recognized, and the lower limit level 10*a* of the target noise and the upper limit level 10*b* of the target noise are essential index values for setting the center level 20*c*, the lower limit level 20*a*, and the upper limit level 20*b* of the masking sound.

In other words, a setting range of the masking sound may be determined only when the upper and lower limit levels of the target noise are known.

Alternatively, in the target noise upper and lower limit level recognition step S10, standard recommendation values recommended according to a space such as a reading room, an office, or a factory may be used as the lower limit level 10*a* of the target noise and the upper limit level 10*b* of the target noise. In this case, the standard recommendation values may be obtained through conventional noise analysis big data. Alternatively, the standard recommendation values may be set based on a result of analyzing ambient noise for a predetermined period by the manager.

Meanwhile, the noise masking method may further include a background noise level recognition step S5 of recognizing a background noise level 5 before performing the target noise upper and lower limit level recognition step S10.

In the background noise level recognition step S5, the background noise level 5 may be preferably recognized to be lower than the lower limit level 10*a* of the target noise. This is because the background noise is ambient noise except for all target noise generated in the surroundings.

In addition, in the background noise level recognition step S5, standard recommendation values recommended according to a space such as a reading room, an office, or a factory may be used. In this case, the standard recommendation values may be obtained through conventional noise analysis big data. Alternatively, the standard recommendation values may be set based on a result of analyzing ambient noise for a predetermined period by the manager.

The reason for recognizing the background noise as described above is that the masking sound may be recognized as noise when the masking sound is output at a high level during a time other than a time when people are active in a specific place, so that an inconvenience caused by the recognition of the masking sound as the noise may be reduced.

When a place of use is an office, a magnitude of noise may be decreased during a predetermined time such as a time before a morning rush hour, a lunch time, or an evening time. In such an environment, the masking sound having a predetermined level or more may be recognized as noise, so that the lower limit level of the masking sound may be appropriately set only when a minimum noise level is known.

The lower limit level of the target noise may refer to low noise at a time when many activities are performed in a target place, and the background noise may be classified as low noise at a time when activities are rarely performed. In a special case, the lower limit level of the target noise and the background noise level may be equal to each other.

After performing the target noise upper and lower limit level recognition step S10, the masking sound center level setting step S20 may be performed.

In the masking sound center level setting step S20, the center level 20*c* of the masking sound may be set based on the lower limit level 10*a* of the target noise and the upper limit level 10*b* of the target noise recognized in the target noise upper and lower limit level recognition step S10.

In this case, the center level 20*c* of the masking sound may be set to be equal to the target noise lower limit level 10*a*, or higher than the target noise lower limit level 10*a* by a predetermined level or more.

In more detail, it may be preferable that the center level 20*c* of the masking sound has the same value as the target noise lower limit level 10*a* that is previously recognized, or is set to be higher than the target noise lower limit level 10*a* that is previously recognized. However, the center level 20*c* of the masking sound may be preferably set to be lower than the target noise upper limit level 10*b*.

This is because the noise masking method through the variable masking sound level conversion according to one aspect of the present disclosure is set based on the target noise lower limit level 10*a*.

Next, a masking sound upper and lower limit level setting step S30 may be performed.

In the masking sound upper and lower limit level setting step S30, the lower limit level 20*a* of the masking sound and the upper limit level 20*b* of the masking sound may be set based on the center level 20*c* of the masking sound set in the masking sound center level setting step S20.

The lower limit level 20*a* of the masking sound and the upper limit level 20*b* of the masking sound may be set in a range of a level at which the masking sound is transmitted.

In this case, the lower limit level 20*a* of the masking sound may be set to be lower than the masking sound center level 20*c*. Meanwhile, the lower limit level 20*a* of the masking sound may be set to be relatively higher than the background noise level 5. This is to cancel or neutralize the background noise that is normally spread even when there is no target noise.

In addition, the upper limit level 20*b* of the masking sound may be preferably set to be higher than the center level 20*c* of the masking sound without exceeding the upper limit level 10*b* of the target noise. According to one aspect of the present disclosure, the masking sound level 20 may not be greater than the target noise upper limit level 10*b*. This is because, when the masking sound level 20 is greater than the target noise upper limit level 10*b*, the masking sound may rather be recognized as noise, so that the masking sound level 20 does not need to be greater than the target noise upper limit level 10*b*.

In summary, it may be appropriate to set the lower limit level 20*a* of the masking sound to be slightly higher than the background noise level 5 to cancel the background noise, and it may be preferable to set the upper limit level 20*b* of the masking sound to be lower than the upper limit level 10*b* of the target noise so that the masking sound itself may not be excessively noisy. In other words, the lower limit level 20*a* of the masking sound and the upper limit level 20*b* of the masking sound may be preferably set between the background noise level 5 and the upper limit level 20*b* of the masking sound.

Meanwhile, according to the noise masking method through the variable masking sound level conversion of one aspect of the present disclosure, the masking sound may be transmitted only at a level within a range between a preset masking sound lower limit level 20*a* and a preset masking sound upper limit level 20*b*.

As drawings related to the above configuration, FIGS. 7 to 9 show a noise masking method implemented in various other environments.

FIG. 3 shows an example in which the lower limit level 20*a* of the masking sound is set to be −8 dB, and the upper limit level 20*b* of the masking sound is set to be +10 dB, based on the masking sound center level 20*c*. FIG. 7 shows an example in which the lower limit level 20*a* of the masking sound is set to be −8 dB, and the upper limit level 20*b* of the masking sound is set to be +5 dB, based on the masking sound center level 20*c*. FIG. 8 shows an example in which the lower limit level 20*a* of the masking sound is set to be −5 dB, and the upper limit level 20*b* of the masking sound is set to be +13 dB, based on the masking sound center level 20*c*. FIG. 9 shows an example in which the lower limit level 20*a* of the masking sound is set to be −8 dB, and the upper limit level 20*b* of the masking sound is set to be +15 dB, based on the masking sound center level 20*c*.

As described above, a range for setting the lower limit level 20*a* of the masking sound and the upper limit level 20*b* of the masking sound based on the masking sound center level 20*c* may be variously changed by settings of the manager according to various places in which noise masking is performed, in which the manager may set the lower limit level 20*a* of the masking sound and the upper limit level 20*b* of the masking sound with reference to big data related to noise, or may set the most appropriate upper and lower limit values by directly measuring the target noise in site.

Next, the target noise level detection step S40 may be performed.

In the target noise level detection step S40, since ambient noise level 10 collected in real time through the noise sensor A310 includes the masking sound level 20, the target noise level 10 obtained by excluding the masking sound level 20 may be detected through the main control unit A120. This is because, since the masking sound is mixed with noise that is actually generated, an actual target noise level 10 may be obtained only when the masking sound is excluded from an original target noise level 10 collected in real time through the sensor. The target noise detection step S40 is a very important step in implementing the noise masking method through the variable masking sound level conversion according to one aspect of the present disclosure.

When the target noise level 10 is lower than the masking sound level 20, the noise collected from the sensor may be continuously increased without being decreased, so that the noise masking may not be normally performed. In order to prevent such a phenomenon, the target noise level detection step S40 of detecting the masking sound level 20 from the target noise level 10 may be required.

Next, the masking sound level adjustment step S50 may be performed.

In the masking sound level adjustment step S50, the masking sound level 20 may be changed by determining the fluctuation trend of the target noise level 10 through the main control unit A120 according to the ambient noise level 10 collected in real time through the sensor.

Next, the masking sound interval adjustment step S60 may be performed.

In the masking sound interval adjustment step S60, the interval for changing the masking sound level 20 may be adjusted by determining the fluctuation trend of the target noise level 10 through the main control unit a120 in which the ambient noise level 10 collected in real time through the sensor is collected.

In the masking sound level adjustment step S50, the trend may be determined based on the average value at which the target noise level 10 is changed from the predetermined time before the current time point to the current time point, and in the masking sound interval adjustment step S60, the interval may refer to the interval at which the masking sound level 20 is changed.

In the masking sound interval adjustment step S60, it may be determined that a change state is maintained for a predetermined time after the target noise is continuously increased or decreased by a predetermined level or more, or rapidly increased or decreased, and an interval for changing the masking sound level 20 may be adjusted through the main control unit A120.

In the masking sound interval adjustment step S60, the main control unit A120 may classify the trend based on the average value of the target noise level 10 from the predetermined time before the current time point to the current time point into categories such as a "gradual increase", a "gradual decrease", a "rapid increase", a "rapid decrease", and the "target noise lower limit level 10*a*", and the interval for changing the masking sound level 20 may be adjusted according to each situation.

In addition, in the masking sound level adjustment step S50, when the target noise level 10 is determined to be maintained lower than the lower limit level 10*a* of the target noise for a predetermined time, the masking sound level 20 may be decreased to the lower limit level 20*a* of the masking sound through the main control unit A120.

The target noise level 10 being lower than the lower limit level 10*a* of the target noise may mean that the target noise level 10 is decreased to a level equal to the background noise level 5, which means that the masking sound level 20 has to be decreased to the lower limit level 20*a* of the masking sound.

In more detail, as shown in FIG. 6, in the masking sound level adjustment step S50, when the target noise level 10 becomes lower than the lower limit level 10*a* of the target noise, first, the masking sound level 20 may be fixed to the masking sound center level 20*c* through the main control unit A120. When the target noise level 10 is determined to be maintained lower than the lower limit level 10*a* of the target noise for 7 to 13 seconds (69 s to 77 s), a control unit C may decrease the masking sound level 20 to the lower limit level 20*a* of the masking sound in stages. In this case, an interval at which the masking sound level 20 is decreased may preferably be 2 seconds. Through the above process, the masking sound level 20 may be prevented from rapidly decreased below the masking sound center level 20*c*, and the masking sound itself may be prevented from being recognized as noise due to a rapid change of the masking sound level 20.

In this case, in the masking sound level adjustment step S50, the masking sound center level 20*c* may serve as a buffer line for preventing the masking sound level 20 from being rapidly decreased. The masking sound center level 20*c* may serve to block and hold the decrease of the masking sound level 20 until a predetermined criterion is satisfied, and when an average magnitude of the target noise level 10 for a predetermined period is determined, and the target noise level 10 is determined to be maintained lower than the lower limit level 10*a* of the target noise for 7 to 13 seconds, the main control unit A120 may allow the masking sound level 20 to be decreased below the masking sound center level 20*c*.

When the masking sound level 20 is rapidly changed, an ear of a human body may recognize the masking sound itself as noise, and when the masking sound level 20 is gradually changed, the ear of the human body may become insensitive to the change of the masking sound so that the recognition of the masking sound as the noise may be alleviated. However, when the masking sound level 20 is changed too gradually, the target noise may be recognized, so that appropriate time adjustment will be required.

After the masking sound level 20 is adjusted through the main control unit A120 in the masking sound level adjustment step S50, finally, the masking sound output step S70 may be performed.

In the masking sound output step S70, the masking sound may be output through the masking sound output unit A140 based on the masking sound level 20 adjusted through the main control unit A120 in the masking sound level adjustment step S50 so as to cancel or neutralize the noise.

Through such a series of processes, the masking sound may be output to cancel or neutralize the noise in the space so as to achieve the noise masking, which is an object of one aspect of the present disclosure, and the fluctuation trend of the target noise level 10 may be determined to adjust the interval for changing the masking sound level 20 so that the masking sound itself may be prevented from being recognized as noise.

As a drawing related to the above configuration, FIG. 4 shows processes including both a technical feature of determining that the change state is maintained for the predetermined time after the target noise is increased or decreased by a predetermined level or more and changing the interval for changing the masking sound level 20 through the main control unit A120 (FIG. 5), and a technical feature of determining that the target noise level 10 is maintained lower than the lower limit level 10*a* of the target noise for the predetermined time and decreasing the masking sound level 20 to the lower limit level 20*a* of the masking sound through the main control unit A120 (FIG. 6).

Hereinafter, the noise masking method through the variable masking sound level conversion according to one aspect of the present disclosure will be described in detail through Examples, Comparative Examples, and Experimental Examples as follows.

Experimental Example 1. Determination of Optimal Delay Time at which Interval for Changing Masking Sound Level Starts to Change An optimal delay time at which an interval for changing a masking sound level starts to change was determined. Prior to the experiment, a general reading room environment was set up, and a degree in which target noise or a masking sound is perceived as noise was measured by test subjects, which are 20 adult men and women that are aged 20 to 40.

First, a background noise level was set to be 35 dB. Then, a lower limit level of the target noise was determined to be 42 dB, and an upper limit level of the target noise was determined to be 62 dB. Based on the above values, a center level of the masking sound was set to be 45 dB. Based on 45 dB that is a center level value of the masking sound, a lower limit level of the masking sound was set to be 37 dB, and an upper limit level of the masking sound was set to be 55 dB.

For the experiment, the target noise was artificially transmitted, and decibel of the transmitted target noise was set to randomly fluctuate between 55 dB and 62 dB.

In this case, in order to find the optimal delay time at which the interval for changing the masking sound level starts to change, the transmitted target noise was artificially and rapidly decreased from 58 dB to 45 dB (−13 dB). Then, according to settings of a control unit, if the interval for changing the masking sound level was set to be 2 seconds, the interval may be changed in a unit of 1 second when a rapid change as described above occurs.

A required interval (delay time) was set between 1 and 9 seconds by the control unit. The set interval means a change of the masking sound level through the control unit when a change trend of an increase or decrease state of the target noise is maintained for the time set as the interval upon an increase of a decrease of the target noise. In other words, if the interval is set to be 2 seconds, the masking sound level 20 is changed by one step when the target noise is increased or decreased for 2 seconds, and the set interval is changed as rapidly as possible when the target noise is rapidly changed as described above, which corresponds to a temporal change in a unit of 1 second when operating in an interval setting of 2 seconds. When the target noise is changed again to have a gradual change, the interval may return to an originally set interval level.

For example, Examples 1 to 3 and Comparative Examples 1 to 2 applied to the present experiment are as follows.

Comparative Example 1: The target noise was determined to be decreased from 58 dB to 45 dB, and after 1 second, the interval at which the masking sound level is decreased was changed from 2 seconds to 1 second.

Example 1: The target noise was determined to be decreased from 58 dB to 45 dB, and after 3 seconds, the interval at which the masking sound level is decreased was changed from 2 seconds to 1 second.

Example 2: The target noise was determined to be decreased from 58 dB to 45 dB, and after 5 seconds, the interval at which the masking sound level is decreased was changed from 2 seconds to 1 second.

Example 3: The target noise was determined to be decreased from 58 dB to 45 dB, and after 7 seconds, the interval at which the masking sound level is decreased was changed from 2 seconds to 1 second.

Comparative Example 2: The target noise was determined to be decreased from 58 dB to 45 dB, and after 9 seconds, the interval at which the masking sound level is decreased was changed from 2 seconds to 1 second.

Recruited panelists were allowed to determine and evaluate a case where the target noise is recognized and a case where the masking sound is recognized with 1 to 5 points by using a 5-point scaling scheme. The evaluation was performed with 1 to 5 points for whether reading is interrupted and disturbed. A lower score means that corresponding noise is not audible and does not cause interruption. An evaluation score for each item was expressed as an average value.

TABLE 1

| | Degree in which Masking Sound is Perceived to Cause Interruption (Average Evaluation Score) | Degree in which Target Noise is Perceived to Cause Interruption (Average Evaluation Score) | Average Value for Each Case (Average Evaluation Score) |
|---|---|---|---|
| Comparative Example 1 (Delay for 1 second) | 4.8 | 2.2 | 3.5 |
| Example 1 (Delay for 3 seconds) | 2.8 | 2.2 | 2.5 |
| Example 2 (Delay for 5 seconds) | 2.2 | 2.4 | 2.3 |
| Example 3 (Delay for 7 seconds) | 2.2 | 2.6 | 2.4 |
| Comparative Example 2 (Delay for 9 seconds) | 2.0 | 4.2 | 3.1 |

As a result, when the target noise is determined to be decreased from 58 dB to 45 dB, and after 5 seconds, the interval at which the masking sound level is decreased is changed from 2 seconds to 1 second, the number of the cases where the target noise and the masking sound are recognized as noise was the least.

Meanwhile, in a case of Comparative Example 1 in which the target noise is determined to be decreased from 58 dB to 45 dB, and after 1 second, the interval at which the masking sound level is decreased is changed from 2 seconds to 1 second, tendency that the rapidly changed masking sound is recognized to cause interruption to concentration was observed; and in a case of Comparative Example 2 in which the target noise is determined to be decreased from 58 dB to 45 dB, and after 9 seconds, the interval at which the masking sound level is decreased is changed from 2 seconds to 1 second, tendency that the target noise is recognized to cause interruption to concentration was observed as a period during which a gap between the masking sound level and the target noise level is increased becomes longer.

Accordingly, it was found that a time point to start changing the interval at which the masking sound level is decreased from 2 seconds to 1 second after the target noise is determined to be decreased from 58 dB to 45 dB is appropriately 3 to 7 seconds, and most preferably 5 seconds.

Experimental Example 2. Determination of Optimal Buffering Time for Fixing Masking Sound Level to Masking Sound Center Level when Target Noise Level Becomes Lower than Lower Limit Level of Target Noise When a target noise level becomes lower than a lower limit level of target noise, an optimal buffering time for fixing a masking sound level to a masking sound center level was determined. Prior to the experiment, a general reading room environment was set up, and a degree in which the target noise or a masking sound is perceived as noise was measured by test subjects, which are 20 adult men and women that are aged 20 to 40.

First, a background noise level was set to be 35 dB. Then, a lower limit level of the target noise was determined to be 42 dB, and an upper limit level of the target noise was determined to be 62 dB. Based on the above values, a center level of the masking sound was set to be 45 dB. Based on 45 dB that is a center level value of the masking sound, a lower limit level of the masking sound was set to be 37 dB, and an upper limit level of the masking sound was set to be 55 dB.

For the experiment, the target noise was artificially transmitted, and decibel of the transmitted target noise was set to randomly fluctuate between 42 dB and 54 dB.

In this case, when the target noise level becomes lower than the lower limit level of the target noise, in order to find the optimal buffering time for fixing the masking sound level to the masking sound center level, the transmitted target noise was artificially and rapidly decreased from 42 dB to 35 dB (−7 dB). Then, settings of a control unit is changed to change a period during which the masking sound level is fixed to 45 dB, which is the masking sound center level, and to start to decrease the masking sound level again to 37 dB, which is the lower limit level of the masking sound, after a buffering time.

For example, Examples 1 to 3 and Comparative Examples 1 to 2 applied to the present experiment are as follows.

Comparative Example 3: The target noise was determined to be decreased below 42 dB, which is the lower limit level of the target noise, the masking sound level was fixed to 45 dB for 4 seconds, and the masking sound level was decreased to 37 dB in stages.

Example 4: The target noise was determined to be decreased below 42 dB, which is the lower limit level of the target noise, the masking sound level was fixed to 45 dB for 7 seconds, and the masking sound level was decreased to 37 dB in stages.

Example 5: The target noise was determined to be decreased below 42 dB, which is the lower limit level of the target noise, the masking sound level was fixed to 45 dB for 10 seconds, and the masking sound level was decreased to 37 dB in stages.

Example 6: The target noise was determined to be decreased below 42 dB, which is the lower limit level of the target noise, the masking sound level was fixed to 45 dB for 13 seconds, and the masking sound level was decreased to 37 dB in stages.

Comparative Example 4: The target noise was determined to be decreased below 42 dB, which is the lower limit level of the target noise, the masking sound level was fixed to 45 dB for 16 seconds, and the masking sound level was decreased to 37 dB in stages.

Recruited panelists were allowed to determine and evaluate a case where the target noise is recognized and a case where the masking sound is recognized with 1 to 5 points by using a 5-point scaling scheme. The evaluation was performed with 1 to 5 points for whether reading is interrupted and disturbed. A lower score means that corresponding noise is not audible and does not cause interruption. An evaluation score for each item was expressed as an average value.

TABLE 2

| | Degree in which Masking Sound is Perceived to Cause Interruption (Average Evaluation Score) | Degree in which Target Noise is Perceived to Cause Interruption (Average Evaluation Score) | Average Value for Each Case (Average Evaluation Score) |
|---|---|---|---|
| Comparative Example 3 (Fixed for 4 seconds) | 2.8 | 1.2 | 2.0 |
| Example 4 (Fixed for 7 seconds) | 1.6 | 1.2 | 1.4 |
| Example 5 (Fixed for 10 seconds) | 1.2 | 1.2 | 1.2 |
| Example 6 (Fixed for 13 seconds) | 1.2 | 1.4 | 1.3 |
| Comparative Example 4 (Fixed for 16 seconds) | 1.2 | 2.8 | 2.0 |

As a result, when the target noise was determined to be decreased below 42 dB, which is the lower limit level of the target noise, the masking sound level was fixed to 45 dB for 10 seconds, and the masking sound level was decreased to 37 dB in stages, the number of the cases where the target noise and the masking sound are recognized as noise was the least.

Meanwhile, when the target noise was determined to be decreased below 42 dB, which is the lower limit level of the target noise, the masking sound level was fixed to 45 dB for 4 seconds, and the masking sound level was decreased to 37 dB in stages, tendency that the rapidly changed masking sound is recognized to cause interruption to concentration was observed; and when the target noise was determined to be decreased below 42 dB, which is the lower limit level of the target noise, the masking sound level was fixed to 45 dB for 16 seconds, and the masking sound level was decreased to 37 dB in stages, tendency that the target noise is recognized to cause interruption to concentration was observed as a period during which a gap between the masking sound level and the target noise level is increased becomes longer.

Accordingly, it was found that a period for fixing the masking sound level to the masking sound center level by determining that the target noise is decreased to a value that is below the lower limit level of the target noise is appropriately 7 to 13 seconds, and most preferably 10 seconds.

As found through Experimental Examples 1 and 2, according to the noise masking method through the variable masking sound level conversion, the masking sound level may be changed with a buffer time (delay time) without changing the masking sound level too rapidly or gradually, so that the masking sound itself may be prevented from being recognized as noise.

Therefore, it was found through Experimental Example 1 that the time point to start changing the interval at which the masking sound level is decreased from 2 seconds to 1 second after the target noise is rapidly decreased is appropriately 3 to 7 seconds, and most preferably 5 seconds.

In addition, it was found through Experimental Example 2 that the period for fixing the masking sound level to the masking sound center level by determining that the target noise is decreased to the value that is below the lower limit level of the target noise is appropriately 7 to 13 seconds, and most preferably 10 seconds.

Accordingly, according to one aspect of the present disclosure, the noise masking method through the variable masking sound level conversion has been developed as a specific method for preventing the masking sound from being recognized as noise due to the rapid change of the masking sound level.

Although the present disclosure has been described with the accompanying drawings, the description merely corresponds to one embodiment among various embodiments including the gist of the present disclosure and is provided to enable those of ordinary skill in the art to easily implement the present disclosure, and it is to be clearly understood that the present disclosure is not limited to the embodiments described above. Therefore, the scope of the present disclosure is to be defined by the appended claims, and the scope of the present disclosure encompasses all technical ideas within the scope of equivalents thereof by changes, substitutions, substitutions, and the like without departing from the gist of the present disclosure. In addition, it is to be clearly understood that some elements in the drawings are exaggerated or reduced than actual elements to more clearly describe the elements.

What is claimed is:

1. A noise masking method through variable masking sound level conversion, which is a method of masking target noise by transmitting a target noise level based on an ambient noise collected through a sensor to a control unit, generating a masking sound for masking the target noise through the control unit, and outputting the masking sound through an output device, the noise masking method comprising:

a target noise upper and lower limit level recognition step (S10) of recognizing a lower limit level and an upper limit level of the target noise;

a masking sound center level setting step (S20) of setting a center level of the masking sound based on the lower limit level and the upper limit level of the target noise recognized in the target noise upper and lower limit level recognition step (S10);

a masking sound upper and lower limit level setting step (S30) of setting a lower limit level and an upper limit level of the masking sound based on the center level of the masking sound set in the masking sound center level setting step (S20);

a target noise level detection step (S40) of detecting the target noise level by comparing the target noise with noise output as the masking sound in the ambient noise collected from the sensor;

a masking sound level adjustment step (S50) of adjusting a level of the masking sound to a level set in the masking sound upper and lower limit level setting step (S30) by determining a fluctuation trend of the target noise level through the control unit according to a level of the ambient noise collected in real time through the sensor;

a masking sound interval adjustment step (S60) of adjusting a level change interval of the masking sound by determining the fluctuation trend of the target noise level in performing the masking sound level adjustment step (S50); and a masking sound output step (S70) of outputting the masking sound through the output device based on the level of the masking sound adjusted through the control unit in the masking sound level adjustment step (S50).

2. The noise masking method of claim 1, further comprising a background noise level recognition step (S5) of recognizing a level of background noise before performing the target noise upper and lower limit level recognition step (S10).

3. The noise masking method of claim 1, wherein, in the masking sound level adjustment step (S50), the trend is determined based on an average value of the target noise level (10) from a predetermined time before a current time point to the current time point, and the interval refers to an interval at which the masking sound level is changed.

4. The noise masking method of claim 1, wherein, in the masking sound level adjustment step (S50), when a change state is determined to be maintained for a predetermined time after the target noise is increased or decreased by a predetermined level or more, an interval for changing a level value of the masking sound is changed through the control unit.

5. The noise masking method of claim 1, wherein, in the masking sound level adjustment step (S50), when the target noise level is determined to be maintained lower than the lower limit level of the target noise for a predetermined time, through the control unit, the level of the masking sound is fixed to a preset masking sound center level and maintained for a predetermined time, and the level of the masking sound is decreased to the lower limit level of the masking sound after the predetermined time.

* * * * *